US006062394A

United States Patent [19]

Bielagus

[11] Patent Number: 6,062,394

[45] Date of Patent: May 16, 2000

[54] MODULAR WOOD PARTICLE SCREEN

[75] Inventor: Joseph B. Bielagus, Tualatin, Oreg.

[73] Assignee: Beloit Technologies, Inc., Wilmington, Del.

[21] Appl. No.: 09/195,915

[22] Filed: Nov. 19, 1998

[51] Int. Cl.[7] ..... B07B 1/28; B07B 1/42; B07B 1/49

[52] U.S. Cl. ..... 209/320; 209/310; 209/322; 209/397; 209/369

[58] Field of Search ..... 209/310, 311, 209/314, 320, 324, 319, 397, 382, 364, 369

[56] References Cited

U.S. PATENT DOCUMENTS

| | | | |
|---|---|---|---|
| 1,248,686 | 12/1917 | Lindh . | |
| 1,269,947 | 6/1918 | Mark . | |
| 2,775,347 | 12/1956 | Weston | 209/314 |
| 3,217,881 | 11/1965 | Wehner . | |
| 3,633,745 | 1/1972 | Wehner et al. | 209/310 |
| 3,796,311 | 3/1974 | Drause | 209/382 |
| 4,122,006 | 10/1978 | Christensen et al. . | |
| 4,298,464 | 11/1981 | Djukastein | 209/310 |
| 4,469,592 | 9/1984 | Krause et al. . | |
| 4,575,420 | 3/1986 | Blachetta et al. . | |
| 4,732,670 | 3/1988 | Nelson | 209/314 |
| 4,787,461 | 11/1988 | Rogus | 171/27 |
| 4,819,810 | 4/1989 | Hoppe . | |
| 4,906,352 | 3/1990 | Nelson | 209/319 |
| 5,037,537 | 8/1991 | Bielagus . | |
| 5,266,161 | 11/1993 | Kroeker | 162/96 |
| 5,301,815 | 4/1994 | Chauvin et al. . | |
| 5,749,471 | 5/1998 | Andersson . | |
| 5,769,240 | 6/1998 | Middour et al. . | |

FOREIGN PATENT DOCUMENTS

| | | | |
|---|---|---|---|
| 238994 | 12/1945 | Switzerland | 209/310 |

*Primary Examiner*—Donald P. Walsh
*Assistant Examiner*—Daniel K. Schlak

[57] ABSTRACT

A modular screening apparatus has four parallel shafts arranged in a single plane mounted to each module. The shafts extend between the sides of the machine frame and are driven by a motor and timing belts which connect the shafts directly or indirectly to the drive motor. Each shaft supports three beater bars which are equally spaced about the axis of the shaft. A screen bed defined by a perforated polyurethane plastic sheet overlies the plane containing the driven shafts. The sheet serves as a screen which is clamped at its upstream edge, the downstream end extending over a fixed bar and vertically downwardly, to suspend a weight. The sides of the screen abut adjustable side plates which are mounted to the machine frame and define the boundaries of the screen bed. The beater bars rotate on the shafts to strike the underside of the screen.

21 Claims, 3 Drawing Sheets

MODULAR WOOD PARTICLE SCREEN

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to apparatus for cleaning and separating materials in general and wood chips in particular.

Paper is typically manufactured from cellulose fibers obtained from wood. The fibers may be separated from the raw wood either mechanically, typically by abrasion, or chemically by dissolving the lignin which binds the fibers in wood together. The process of chemically dissolving the lignin involves reducing wood to chips of uniform thickness which are processed by cooking the chips in a chemical solution until the lignin has been dissolved. To maximize the amount of useful fiber from a given quality of chips the thickness of the chips should be uniform to prevent over thickness chips from requiring excessive digestion time which can result in the degradation of some fiber due to prolonged contact with the digestion liquid.

The process of reducing the raw logs into chips produces a certain amount of dust, fines and pins. Dust or fines are wood particles which are too small to contain useful fiber. Pins are larger particles which contain some useful fiber which can be used in papermaking if the percentage of pulp derived from pins is not too large.

A number of different apparatus have been developed for separating wood chips by size, particularly thickness. These machines include disk screens and bar screens, see for example my earlier U.S. Pat. Nos. 5,476,179 and 5,392,931 to bar screens, and U.S. Pat. No. 4,972,960 to a disk screen. Devices for separating wood chips by ballistic cross-section have also been developed, see for example U.S. Pat. No. 5,409,118. An apparatus known as a chip destructuring device, such as is disclosed in U.S. Pat. No. 4,953,795 cracks large chips to allow chemical liquors to penetrate the chips for more uniform processing. While these devices have been found to be useful and advantageous for separating wood chips by size and removing knots, tramp metal, and rocks, or separating sand and useful wood fines, a device known as a wave screen and described in my earlier U.S. Pat. No. 5,037,537 which is incorporated herein by reference, is particularly useful for separating dust and fines from wood chips. A wave screen has the ability to separate out dust and fines while retaining slightly larger particles, referred to as pins, which contain useful fiber, with the accept flow.

Disk screens, bar screens, and air density separators have also found application in separating and cleaning municipal trash in preparation for recycling some or all components of a stream of trash. A wave screen can also be used to separate or clean certain materials from municipal trash.

A wave screen type machine, while quite useful because of its ability to remove only particles which contain no useful fiber from a stream of wood chips, could benefit from design changes which would facilitate modularity and reduce maintenance, while at the same time increasing utility when used to process municipal trash.

SUMMARY OF THE INVENTION

The wave screen of this invention is modular. Each module consists of a machine frame on which are mounted four parallel shafts which are arranged in a single plane. The shafts extend between the sides of the machine frame and are driven by a motor and timing belts which connect the shafts directly or indirectly to the drive motor. Each shaft supports three beater bars which are equally spaced about the axis of the shaft. A screen bed is defined which overlies the plane containing the driven shafts. The screen bed consists of a polyurethane plastic sheet approximately 3/16th inches thick which is penetrated by a multiplicity of holes to form a screen.

The screen is clamped at the upstream edge, while the downstream end extends over a fixed bar and extends vertically downwardly, to suspend a weight along its downstream edge. The sides of the screen abut adjustable side plates which are mounted to the machine frame and define the boundaries of the screen bed. The beater bars mounted to the shafts have a width approximately one-half inch less than the width of the screen. The beater bars rotate on the shafts to strike the underside of the screen. Each module of the wave screen is typically tilted so that the screen forming each unit tilts approximately seven degrees downwardly from the upper edge to the fixed bar. The effect of the beater bars is to strike through the screen material placed on the screen. This action causes the material on the screen to shed material loosely attached thereto and causes the material to become airborne. Small particles will, after traveling upwardly a short distance, fall downwardly onto the screen material and, if below a determined size, will pass through the screen material.

Two to five or more modules may be arranged in sequential descending order to increase the cleaning capability and intensity of a screening unit.

It is a feature of the present invention to provide a wave screen which is modular in nature.

It is a further feature of the present invention to provide a screening device which actively separates small particles from larger particles to which the small particles are adhered.

It is a yet further feature of the present invention to provide a screening device in which the screen is less subject to wear.

It is a still further feature of the present invention to provide a screening device wherein the opening may be tailored in size and shape to achieve separation of a particular component from a stream of material.

Further objects, features and advantages of the invention will be apparent from the following detailed description when taken in conjunction with the accompanying drawings.

DESCRIPTION OF THE PREFERRED EMBODIMENTS

Figure 1:
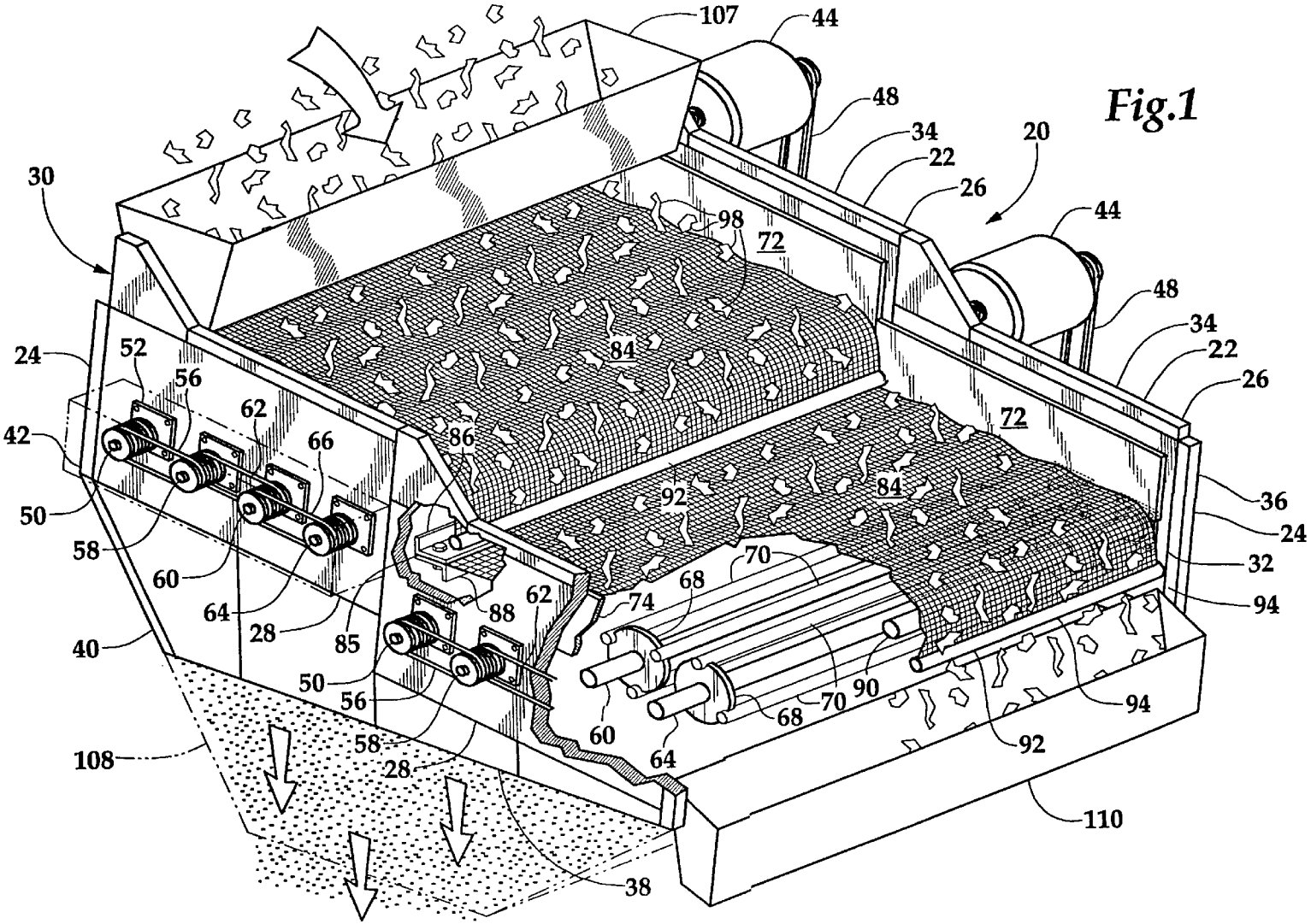
FIG. 1 is an isometric view, partly cut-away in section, of a two module wave screen.
Figure 2:
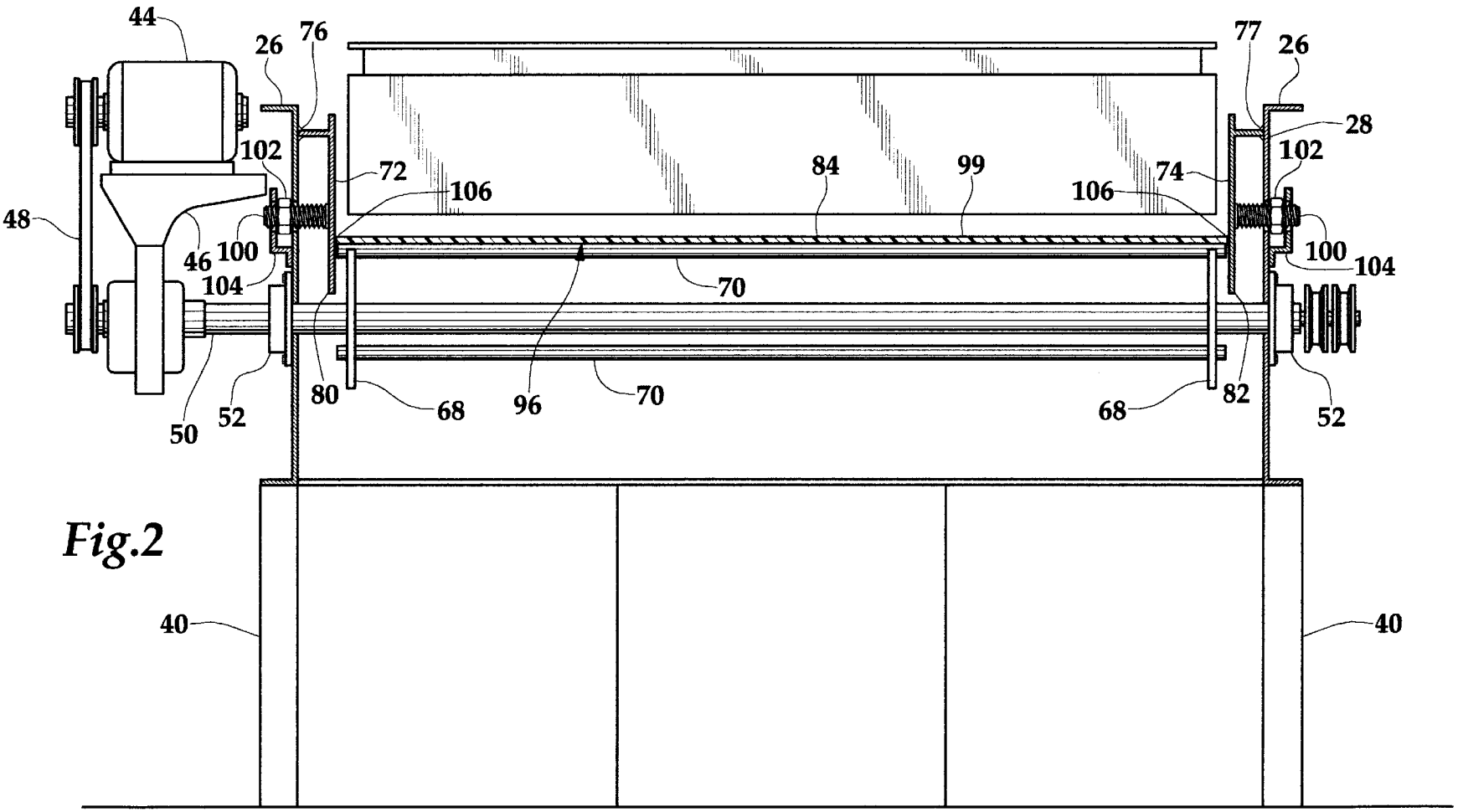
FIG. 2 is an end elevational view of the wave screen of FIG. 1.
Figure 3:
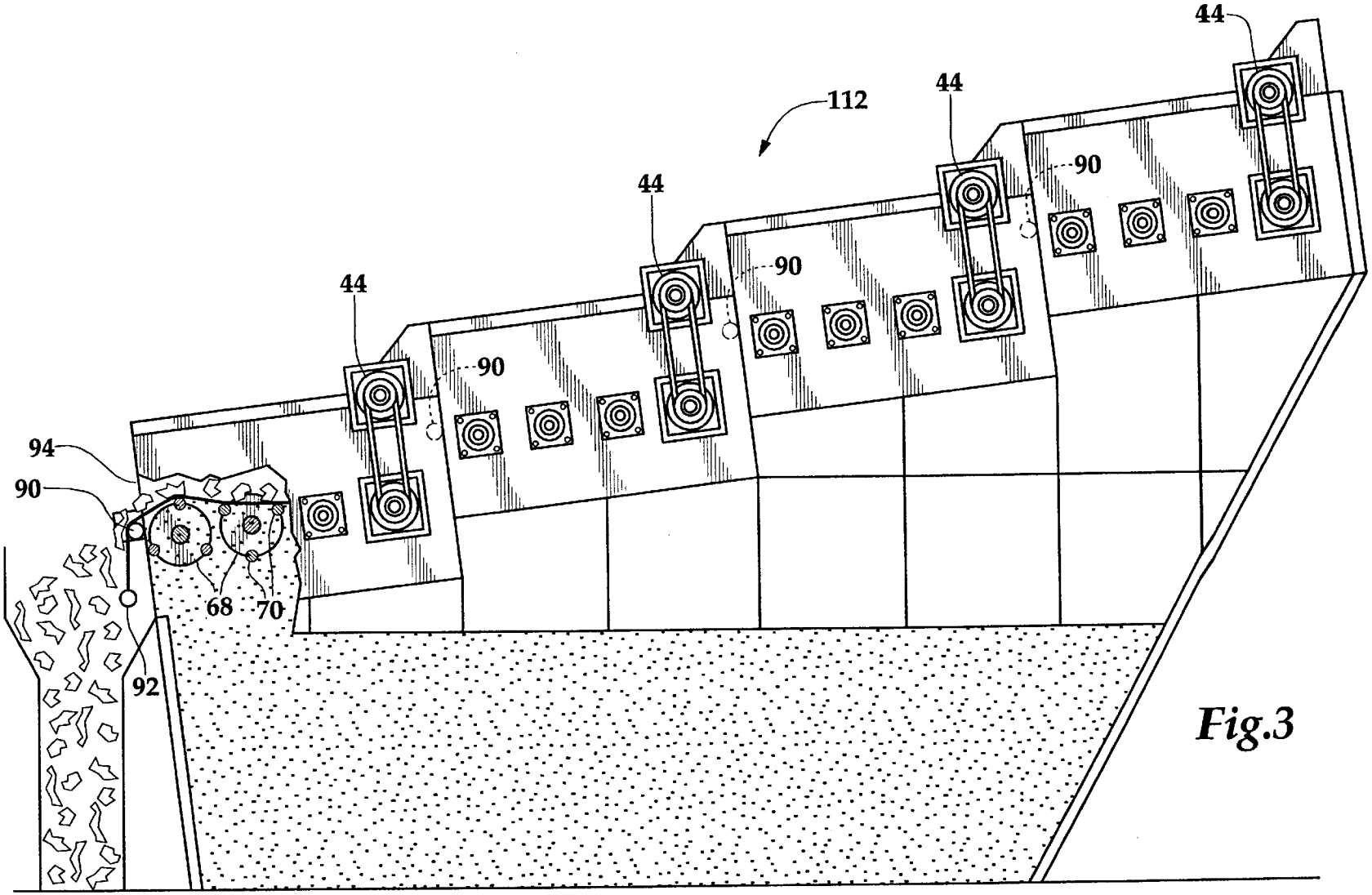
FIG. 3 is a side elevational view of a four module wave screen based on the modules shown in FIG. 1.

Referring more particularly to FIGS. 1–3, wherein like numbers refer to similar parts, a wave screen 20 having two modules 22 is shown in FIG. 1. Each module 22 has a frame 24 with a drive side 26 and a side 28 opposite the drive side 26. The drive side 26 and the opposed side 28 are joined by an infeed side 30 and an outfeed side 32 to form a rectangular box 34 which is approximately four feet ten inches from infeed to outfeed and which is approximately six feet ten inches, from side to side. The rectangular box 34 forming the first module 36 is mounted to a first support stand 38 which supports the first module 36 at a selected angle, shown in FIG. 1 as seven degrees. A second support stand 40 supports the second module 42 at the same angle as the first module 36 and positions the second module 42 adjacent to and above the first module 36.

Each module has a motor 44 supported on a bracket 46 which is connected by a timing belt 48 to a first shaft 50 which extends between the sides 26, 28 of the module 22. The shaft 50 is mounted by bearings 52. The shaft end 54 opposite the motor is connected by a timing belt 56 to a second shaft 58 which is also mounted on bearings to the frame 24 in spaced parallel relation to the first shaft 50. The second shaft 58 in turn drives a third shaft 60 by means of a timing belt 62. The third shaft 60 drives a fourth shaft 64 by a timing belt 66. Thus the four shafts are driven together by the motor 44. Each of the shafts 50, 58, 60, 64 has two supports 68 which are spaced apart and mounted to the shaft. The supports 68 hold three beater bars 70 which are uniformly spaced about and parallel to the axis defined by each shaft. The radial distances between the shaft and the beater bars is also uniform. The beater bars 70 extend axially about six inches on either side of the supports 68. The timing belts connect the shafts so that the bars mounted to the shafts strike the screen in a consistent pattern.

Adjustable side plates 72 on the drive side and adjustable side plates 74 opposed to the drive side, are spaced inwardly of the sides 26, 28 and are approximately parallel to one another on either side of the screen 84. The shafts are longer than the distance between the side plates 72, 74 and extend beneath the side plates. The adjustable plates 72, 74 are welded to or co-formed with the sides 26, 28 and depend downwardly from upper portions 76, 77 of the wave screen sides 26, 28. The adjustable sides plates 72, 74 have lower edges 80, 82 which extend below the path swept out by beater bars 70 as they rotate on the shafts 50, 58, 60, 64 as shown in FIG. 2. A flexible screen 84 is formed of polyurethane with many circular holes. The screen 84 defines a screen bed of foraminous flexible material having a chip receiving surface. The screen 84 has an infeed edge 85 which is clamped between an upper steel angle 86 and a lower steel angle 88. The lower steel angle 88 is mounted to the infeed side 30 of the wave screen box 34. The screen 84 extends along and abuts the adjustable side plates 72, 74. The screen 84 passes over a fixed bar 90 at the outfeed side 32 of the wave screen module 22 and is ballasted by a weight 92 which is attached to the of the outfeed end 94 of the screen 84. The weight 92 serves to bias the outfeed end 94 to provide a substantially uniform tension between the upstream end and the downstream end. The fixed bar 90 is conveniently attached to the next downstream module to insure overlapping of the first screen with the second screen. The ballast weight 92 may consist of a steel bar weighing between seventy-five and one-hundred lbs which is formed as two portions which are screwed together to clamp the outfeed end 94 of the screen 84 therebetween.

The beater bars 70 are timed by the timing belts 56, 62, 66 which fixes the angular position of the shafts on which the beater bars 70 are mounted. The bars 70 are positioned so that they strike the underside 96 of the screen 84 sequentially which tends to facilitate moving material along the upper surface 99 of the screen 84.

The adjustable side plates 72, 74 are adjusted by bolts 100 which are attached to the sides of the adjustable plates opposite the screen surface 99. The bolts 100 are not shown to scale in FIG. 2, but are greatly enlarged for illustrative purposes only. The bolts 100 extend through the sides 26, 28 where adjustment nuts 102 contained in capture brackets 104 are threadedly engaged with the bolts 100 so that rotation of the bolts 100 can bend the adjustable plates 72, 74 inward toward the sides 26, 28 or outwardly toward the screen 84. In this way the sides plates 72, 74 can be adjusted to closely engage the edges 106 of the screen 84.

Because the screen 84 is held only at the infeed edge 85 and not by the screen side edges 106, flexure occurs only in a single plane. Simple curvature such as caused by wrapping a sheet of material, about a cylinder causes no in-plane strain in the screen 84. Strain produced by a simple curve is limited to tension and compression of the upper surface relative to the lower surface of the belt. If the bar 90 about which the screen 84 is turned has a radius of three inches and the screen 84 wraps a sector of ninety degrees, and if the screen 84 has a thickness of 3/16th of an inch, the through thickness strain for the screen will be about three percent. That is the amount of tensile strain experienced by the top surface of the screen with respect to the center of the screen, and the amount of compressive strain experienced by the surface at the bottom of the belt. A three percent strain is well within the elastic limit of the polyurethane used to form the screen 84.

The relatively unconstrained screen 84 can uniformly be engaged by the beater bars 70 reducing concentrated wear on particular regions of the screen 84. The screen 84 extends between the side plates and is engaged across substantially its entire width by the beater bars. The side edges of the screen 84 extend to and substantially abut, but are not affixed to, the two side plates. Thus, although the screen 84 is free to move up and down with the beater bars, the side plates prevent material from escaping off the sides of the screen.

The holes formed in the screen 84 can be selected to achieve a particular result. Generally the minimum size hole which may be easily formed by punching is approximately the same diameter as the thickness of the polyurethane screen 84. Thus screen thickness will typically be 3/16th inch and minimum size will likewise be 3/16th inch. Typically hole sizes for separating fines from wood chips will extend up to about 3/8th inch. Other shapes such as slots may be used for cleaning a particular type of material.

In a wood chip application, a chip supply means, for example a hopper or conveyor of chips to be treated, is positioned above an inlet or chip supply means 107 which supplies chips 98 to the wave screen 20, and a continuous inflow of chips and commingled particles of various sizes is introduced to the wave screen. The chip inflow presents a volume of material to be separated into first and second fractions.

The rotating beater bars on the parallel shafts act as an agitating apparatus disposed below the screening bed which induce oscillating movement in the screening bed. This movement causes chips disposed thereon to be repeatedly accelerated away from the chip receiving surface and to return to the chip receiving surface, thereby freeing particles smaller than openings in the foraminous flexible material to pass through the material. The beater rolls, because their outer surfaces are discontinuous provide periods of contact and separation between the rolls and the bed during rotation of the rolls. The smaller particles which pass through the flexible screen are carried away by a first chute 108 which may be in communication with a conveyor (not shown) or a hopper, while the larger particles which travel over the screen surface are carried away by a second chute 110 to an accepts conveyor or bin (not shown).

The wave screen 20 employing a screen with slots can be used to remove dirt and particularly organic maternal sometimes referred to as putrescibles, meaning material likely to become putrid, from municipal trash. Such material can be composted and its removal reduces the tendency of municipal trash to stink.

The wave screen 20 can also be used to separate usable fiber produced from sugar cane waste and corn stalks from dirt and pith.

It should be understood that the screen 84 can be manufactured of a variety of materials including wire screen and that the size of the holes and thickness of the screen material may be varied.

It should also be understood that the number of modules 22 may be two, three, four, five, six or more. Example as shown in FIG. 3 a wave screen 112 has four modules 22. The wave screening modules 22 are arranged in adjacent descending order to sequentially process material to be cleaned and separated.

It should be understood that, the width and length of a module may be varied. The number of shafts and beater bars may also vary. It will be understood by those skilled in the art that the shafts may be linked by chains, gears, linkages, direct drive of each shaft under control of a microprocessor with shaft encoder, and other suitable means for controlling the angular relationship of the shafts.

It should also be understood that the wave screen modules may be mounted at various angles including horizontal to control the flow of material over the wave screen surface.

It is understood that the invention is not limited to the particular construction and arrangement of parts herein illustrated and described, but embraces such modified forms thereof as come within the scope of the following claims.

I claim:

1. A screening apparatus comprising:

a first frame having two side plates arrayed in spaced parallel relation;

a plurality of shafts rotatably mounted on the first frame, each shaft defining one of a plurality of axes, the axes lying in a common plane and extending perpendicularly to the two side plates, each shaft having at least one bar mounted to the shaft for rotation with the shaft, the at least one bar being parallel to and spaced from the shaft axis;

a first screen having a first edge which is parallel to the shaft axes, attached to the frame, the first screen extending over and perpendicular to the plurality of shafts;

portions of the first screen defining a second edge parallel to and spaced from the first edge, the second edge being biased so as to provide a substantially uniform tension between the first edge and the second edge of the first screen, the screen having side edges extending to and substantially abutting but not affixed to the two side plates, the side plates extending perpendicular to the shaft axes, wherein the screen extending between the side plates defines a screen width which is engaged across substantially the entire width by the at least one bar mounted to each shaft, and wherein the two side plates are adjustably positionable, to position portions of the side plates to abut the first screen.

2. The screening apparatus of claim 1 wherein the at least one bar attached to each shaft has a width slightly less than the width of the screen so that the at least one bar fits between the side plates.

3. The screening apparatus of claim 1 wherein the screen is formed of polyurethane at least 3/16th inches thick and portions of said screen forming a plurality of holes at least 3/16th inches in minimum dimension.

4. The screening apparatus of claim 1 wherein each shaft has at least three bars equally spaced about said shaft.

5. The screening apparatus of claim 1 further comprising:

a motor mounted to the frame, the motor connected to drive at least a first one of said shafts; and a plurality of timing belts connecting the shafts, other then the first shaft, to the first shaft so that the bars mounted to the shafts strike the screen in a consistent pattern.

6. The screening apparatus of claim 1 further comprising a second frame positioned adjacent to and below the first frame, the second frame having a second screen mounted thereon, the second screen positioned to receive material from the first screen.

7. A screening apparatus for cleaning and separating material:

a plurality of screening modules arranged in adjacent descending order so as to sequentially process material to be cleaned and separated;

each module having a frame, the frame including two side plates arrayed in spaced parallel relation:

each module having a plurality of shafts rotatably mounted on the frame, each shaft defining one of a plurality of axes, the axes lying in a common plane and extending perpendicularly to the two side plates, each shaft having at least one bar mounted to the shaft for rotation with the shaft, the bar being parallel to and spaced from the shaft axis;

each module having a screen;

the screen having a first edge which is parallel to the shaft axes and attached to the frame, the screen extending over and perpendicular to the plurality of shafts;

the screen having a second edge parallel to and spaced from the first edge, the second edge being biased so as to provide a substantially uniform tension between the first edge and the second edge of the screen;

the screen having side edges extending to and substantially abutting but not affixed to the two side plates, the side plates extending perpendicular to the shaft axes;

wherein the screen extending between the side plates defines a screen width which is engaged across substantially the entire width by the at least one bar mounted to each shaft of the module; and wherein the two side plates of each module have means for adjustably positioning portions of the side plates which abut the screen.

8. The screening apparatus of claim 7 wherein the at least one bar attached to each shaft has a width slightly less than the width of the screen so that the at least one bar fits between the side plates of each module.

9. The screening apparatus of claim 7 wherein the screen is formed of polyurethane at least 3/16th inches thick and portions of said screen forming a plurality of holes at least 3/16th inches in minimum dimension.

10. The screening apparatus of claim 7 wherein each shaft has at least three bars equally spaced about said shaft.

11. The screening apparatus of claim 7 further comprising:

a motor mounted to the frame of each module, the motor connected to drive at least a first one of said plurality of shafts mounted on the frame of each module;

a plurality of timing belts connecting said plurality of shafts, other then the first shaft, to the first shaft so that the bars mounted to the shafts strike the screen in a consistent pattern.

12. A screening apparatus for separating material into first and second fractions based on size, the screen comprising:

a frame having side plates disposed in spaced relation;

a screen bed of foraminous flexible material having a material receiving surface, said bed having an inlet end fixed to the frame, an outlet end and side edges extending therebetween;

wherein said screen bed side edges abut but are not fixed to the side plates and wherein the side plates are adjustably mounted to the frame for motion toward and away from the screen bed edges;

agitating apparatus including a plurality of rotatable beater rolls disposed below said bed for inducing oscillating movement in said bed, causing material thereon to be repeatedly accelerated away from the material receiving surface and to return to the material receiving surface, thereby freeing particles smaller than openings in said foraminous flexible material to pass through said material, said beater rolls having a discontinuous outer surface and being positioned relative to said bed to provide periods of contact and separation between rolls and said bed during rotation of said rolls.

13. The screening apparatus of claim 12 wherein the rotatable beater rolls have a width slightly less than the width of the screen so that the rotatable beater rolls fit between the side plates.

14. The screening apparatus of claim 12 wherein the screen is formed of polyurethane at least 3/16th inches thick and portions of said screen forming a plurality of holes at least 3/16th inches in minimum dimension.

15. The screening apparatus of claim 12 wherein the rotatable beater rolls are mounted on shafts which are mounted to the frame, each shaft having at least three bars equally spaced about said shaft forming the beater roll.

16. The screening apparatus of claim 15 further comprising:

a motor mounted to the frame, the motor connected to drive at least a first one of said shafts; and a plurality of timing belts connecting the shafts, other then the first shaft, to the first shaft so that the bars mounted to the shafts strike the screen to induce progressive wave-like movement of said screen between inlet and an outlet end of said screen.

17. The screening apparatus of claim 12 further comprising a second frame positioned adjacent to and below the first frame, the second frame having a second screen bed mounted thereon, the second screen bed positioned to receive material from the first screen bed.

18. A screening apparatus for separating material into first and second fractions based on size, the screen comprising:

a frame having side plates disposed in spaced relation;

a screen bed of foraminous flexible material having a material receiving surface, said bed having an inlet end fixed to the frame, an outlet end and side edges extending therebetween;

wherein said screen bed side edges abut but are not fixed to the side plates;

agitating apparatus including a plurality of rotatable beater rolls disposed below said bed for inducing oscillating movement in said bed, causing chips thereon to be repeatedly accelerated away from the chip receiving surface and to return to the chip receiving surface, thereby freeing particles smaller than openings in said foraminous flexible material to pass through said material, said beater rolls having a discontinuous outer surface and being positioned relative to said bed to provide periods of contact and separation between rolls and said bed during rotation of said rolls;

a bar which extends between the sides, the bar positioned beneath the screen and closely spaced from the second edge, the screen extending over the bar and turning approximately ninety degrees to depend downwardly from the bar, the second edge being thus spaced beneath the bar;

a weight connected along the second edge, the weight providing a substantially uniform tension between the first edge and the second edge of the screen.

19. The screening apparatus of claim 18 wherein the screen is formed of polyurethane at least 3/16th inches thick and portions of said screen forming a plurality of holes at least 3/16th inches in minimum dimension.

20. A screening apparatus comprising:

a first frame having two side plates arrayed in spaced parallel relation;

a plurality of shafts rotatable mounted on the first frame, each shaft defining one of a plurality of axes, the axes lying in a common plane and extending perpendicularly to the two side plates, each shaft having at least one bar mounted to the shaft for rotation with the shaft, the at least one bar being parallel to and spaced from the shaft axis;

a first screen having a first edge which is parallel to the shaft axes, attached to the frame, the first screen extending over and perpendicular to the plurality of shafts;

portions of the first screen defining a second edge parallel to and spaced from the first edge, the second edge being biased so as to provide a substantially uniform tension between the first edge and the second edge of the first screen, the screen having side edges extending to and substantially abutting but not affixed to the two side plates, the side plates extending perpendicular to the shaft axes, wherein the screen extending between the side plates defines a screen width which is engaged across substantially the entire width by the at least one bar mounted to each shaft;

a bar which extends between the sides, the bar positioned beneath the screen and closely spaced from the second edge, the screen extending over the bar and turning approximately ninety degrees to depend downwardly from the bar, the second edge being thus spaced beneath the bar; and a weight connected along the second edge, the weight providing the substantially uniform tension between the first edge and the second edge of the screen.

21. A screening apparatus for cleaning and separating material:

a plurality of screening modules arranged in adjacent descending order so as to sequentially process material to be cleaned and separated;

each module having a frame, the frame including two side plates arrayed in spaced parallel relation;

each module having a plurality of shafts rotatably mounted on the frame, each shaft defining one of a plurality of axes, the axes lying in a common plane and extending perpendicularly to the two side plates, each shaft having at least one bar mounted to the shaft for rotation with the shaft, the bar being parallel to and spaced from the shaft axis;

each module having a screen;

the screen having a first edge which is parallel to the shaft axes and attached to the frame, the screen extending over and perpendicular to the plurality of shafts;

the screen having a second edge parallel to and spaced from the first edge, the second edge being biased so as to provide a substantially uniform tension between the first edge and the second edge of the screen;

the screen having side edges extending to and substantially abutting but not affixed to the two side plates, the side plates extending perpendicular to the shaft axes;

wherein the screen extending between the side plates defines a screen width which is engaged across substantially the entire width by the at least one bar mounted to each shaft of the module;

each module having a bar which extends between the two side plates, the bar positioned beneath the screen and closely spaced from the second edge, the screen extending over the bar and turning approximately ninety degrees to depend downwardly from the bar, the second edge being thus spaced beneath the bar;

each module having a weight connected along the second edge of the screen of each module, the weight providing the substantially uniform tension between the first edge and the second edge of the screen.

* * * * *